US005098129A

United States Patent [19]

Haber

[11] Patent Number: 5,098,129

[45] Date of Patent: Mar. 24, 1992

[54] BUSINESS CARD ASSEMBLY WITH SELF-ADHESIVE BACKING

[76] Inventor: Robert Haber, 1 Sherwood Dr., Larchmont, N.Y. 10538

[21] Appl. No.: 730,512

[22] Filed: Jul. 12, 1991

Related U.S. Application Data

[63] Continuation of Ser. No. 504,568, Apr. 4, 1990, abandoned.

[51] Int. Cl.[5] ..... B42D 15/00

[52] U.S. Cl. ..... 283/62; 281/2; 281/51; 283/81; 283/117

[58] Field of Search ..... 281/2, 8, 9, 10, 15, 281/1, 12, 51; 283/62, 81, 101, 105, 117

[56] References Cited

U.S. PATENT DOCUMENTS

| | | | |
|---|---|---|---|
| 1,330,730 | 2/1920 | Thompson | 283/105 |
| 2,309,398 | 1/1943 | Keller | 283/105 |
| 2,321,184 | 6/1943 | Butterworth | 283/105 |
| 3,193,307 | 6/1962 | Snyder | 281/15.1 |
| 3,501,365 | 3/1970 | Marshall | 283/101 |
| 3,854,229 | 12/1974 | Morgan | 283/101 |
| 4,174,857 | 11/1979 | Koza | 283/101 |
| 4,272,327 | 6/1981 | Logan | 283/62 |
| 4,711,686 | 12/1987 | Instance | 281/2 |
| 4,822,074 | 4/1989 | Hueffman | 281/2 |
| 4,856,819 | 8/1989 | Gollon | 283/79 |

FOREIGN PATENT DOCUMENTS

ZZX

*Primary Examiner*—Paul A. Bell

*Attorney, Agent, or Firm*—Gottlieb, Rackman & Reisman

[57] ABSTRACT

A business card assembly suitable for use in application with a business catalog or brochure is provided. The card assembly includes a pair of business cards connected along a common edge which defines a perforated score-line. The underside of each of the cards is provided with an adhesive backing which may be selectively removed in order to expose an adhesive surface along the underside of the cards. As a result, each of the cards may be selectively adhered to a display surface, such as a catalog or brochure, or may be left intact with the backing to be used as a conventional business card.

2 Claims, 1 Drawing Sheet

BUSINESS CARD ASSEMBLY WITH SELF-ADHESIVE BACKING

This application is a continuation, of application Ser. No. 504,568, filed Apr. 4, 1990, now abandoned.

BACKGROUND

This application relates to a business card assembly having a self-adhesive backing, and more particularly, to a business-card assembly comprising two business cards connected together along a perforated score line which may be used in conjunction with a business catalog or brochure.

In order to provide information about a company's business, including the products it manufactures, or the services which it can supply, most if not all companies utilize a promotional advertising catalog or composite brochure to transmit information about the business to prospective customers. The catalog or brochure is typically professionally prepared and positively describes the various aspects of the business so that a prospective customer can decide whether or not he or she wishes to utilize the products or services of that business.

More often than not, the catalog or brochure is sent to the prospective customer with a business card of the sales representative, business contact or officer of the business physically attached to the catalog, usually by a paper clip or staple. By attaching the business card to the catalog, the prospective customer may easily determine who at the business he or she should contact for more information about the particular business service or product of interest.

A major disadvantage of clipping a business card onto a catalog is that the card may easily become separated from the catalog, whereby the prospective customer no longer has readily available to him or her the name of the representative or contact at the business.

Another problem is that only one business card is usually clipped or otherwise attached to a catalog. As a result, unless the prospective customer has the catalog in front of him or her, he or she will have little if no information on the business and the representative or contact from the business. This situation often happens when the customer is away from the office, or the catalog has been filed away.

Accordingly, it would be desireable to provide a business card system or assembly suitable for use with a business catalog or brochure which overcomes the above-mentioned disadvantages.

SUMMARY OF THE INVENTION

Generally speaking, in accordance with the invention, a business card system or assembly is provided. The system includes a first card and a second card of substantially the same size removably connected to each other along a common edge which defines a tear line, preferably fold line, and more preferably a perforated score-line. At least one of the cards, preferably both, are provided with a peelable backing which may be removed in order to expose an adhesive surface along the underside of the card.

In application, the backing of one of the cards is removed exposing a self-sticking adhesive so that the card assembly may be attached to a catalog page or brochure, preferably along an edge thereof. The other card of the card assembly has its backing in place when sending the catalog or brochure to a prospective customer.

When the prospective customer receives the catalog with the attached card assembly, the customer may tear along the perforated score-line in order to separate the second card from the adhered first card. The second card may be simply stored in one's wallet in a conventional fashion. Alternatively, the second card may also have its backing removed in order to be secured to a second document, a file which the customer has made up directed to the business or to a conventional "Rolodex" card. Applications of the second card are numerous.

Accordingly, it is an object of the invention to provide an improved business card assembly suitable for use with a business catalog or brochure.

Another object of the invention is to provide a business card which may be adhered to a document or paper, or simply stored in one's wallet, as desired by the user.

Still a further object of the invention is to provide a business card which is not easily separable from the document to which it is attached.

Yet another object of the invention is to provide a business card assembly consisting of a pair of business cards attached along a common perforated score-line.

Still other objects and advantages of the invention will in part be obvious and will in part be apparent from the specification.

The invention accordingly comprises a system and assembly possessing the features, properties, and a relation of elements which will be exemplified hereinafter, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
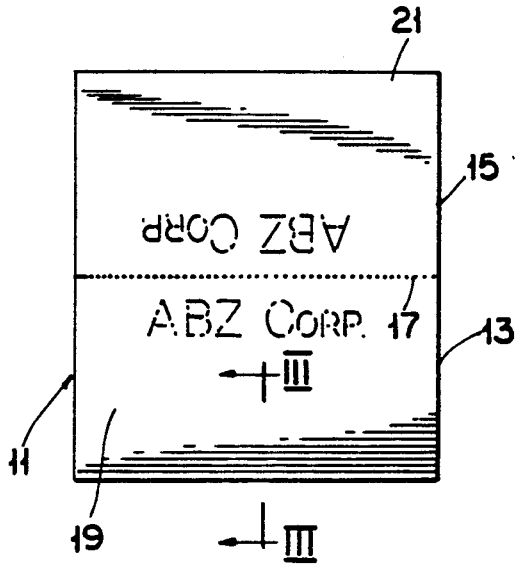
FIG. 1 is a top plan view of a business card assembly made in accordance with the invention.

Referring first to FIG. 1, a business card assembly made in accordance with the invention is generally indicated at 11. Business card assembly 11 includes a printed first business card 13 and a printed second business card 15 of substantially the same size as first business card 13. Each of cards 13 and 15 are preferably made of a stiff paper-like material. Business card 13 and business card 15 have a common edge defining a perforated score-line 17 that is generally known in the art. Each of business cards 13 and 15 include a top side 19 and 21, respectively. Typically, each card has printed thereon information normally found on a conventional business card (see FIG. 1), such as the company name, the name of the company representative, the company address and appropriate telephone numbers.

Figure 2:
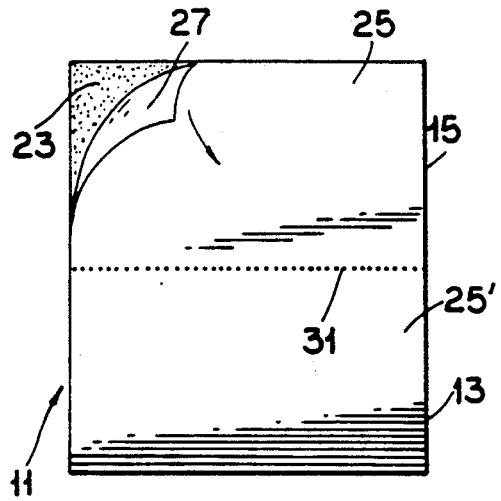
FIG. 2 is a bottom plan view of the business card assembly shown in FIG. 1 which illustrates the backing applied to the pair of business cards of the assembly.
Figure 3:
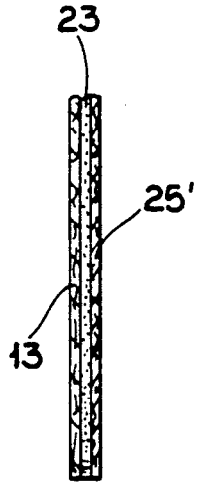
FIG. 3 is a cross-sectional view taken along line 3—3 of FIG. 1.

Turning now to FIGS. 2 and 3, business card assembly 11 includes a first peelable backing 25 adhesively mounted to underside 23 of second business card 15. Similarly, business card assembly 11 also includes a second peelable backing 25′ adhesively mounted to the underside of first business card 13 and attached to first backing 25 at a common edge defining a perforated score-line 31 (see FIG. 2). Each of the backings 25 and 25′ has a backing member 27 which may be separately and selectively removed or detached or peeled from cards 15 and 13 respectively as desired in order to expose the self-sticking underside 23 of cards 13 and 15.

Each of undersides 23 of cards 13 and 15 are provided with an adhesive material which may be used to selectively attach cards 13 and 15 individually to a desired surface, such as a document or other paper. If backing 25 or backing 25′ is not peeled off or otherwise removed, then the adhesive material of underside 23 is not exposed, and cards 13 and 15 may be used in a conventional manner.

Figure 4:
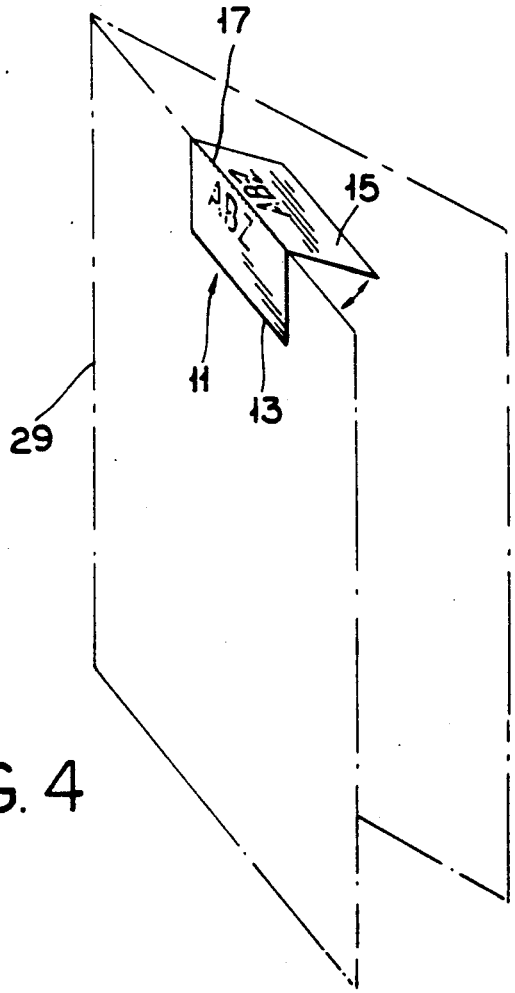
FIG. 4 is a perspective view, partially in phantom, illustrating application of the business card assembly of the invention to a catalog or brochure.

Continuing now with FIG. 4, use of business card assembly 11 in connection with a catalog or other business brochure is illustrated. Prior to mailing or otherwise sending a catalog 29 to a prospective customer, business card assembly 11 is attached to catalog 29 by removing backing 25′ from card 13 and placing the adhesive underside 23 of card 13 on catalog 29, as shown in FIG. 4. Preferably, business card assembly 11 should be attached to catalog 29 so that perforated score-line 17 of assembly 11 is aligned with the top edge of the catalog 29 (see FIG. 4).

As a result, business card assembly 11 is securely attached to catalog 29 and is ready for sending to a prospective customer. When the customer receives catalog 29 along with attached business card assembly 11, the customer may, at his or her option, tear business card assembly 11 along score-line 17 so that second business card 15 may be used as a conventional business card (i.e., stored in one's wallet). If desired, after separating business card 15 from business card 13 (previously adhered to catalog 29), as described above, backing 25 (see FIG. 2) may be removed from card 15 so that card 15 can be adhesively attached to another document, to a file on the business which the customer has made, or to a conventional "Rolodex" card.

Other applications of the business card assembly which may be construed from this disclosure are encompassed by the invention.

It will thus be seen that the objects set forth above, among those made apparent from the proceeding description, are efficiently attained, and since certain changes may be made in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be set to fall therebetween.

What is claimed is:

1. A business card assembly for selective attachment to a catalogue, brochure or the like, said assembly comprising:

a first wallet sized business card of rectangular configuration made of stiff paper stock and bearing information, a second wallet sized business card of rectangular configuration made of stiff paper stock and bearing information, said first and second cards being of like configuration and being removably connected along common, adjacent edges by a perforated tear line, an adhesive layer on the undersides of both cards, and a backing sheet of a rectangular configuration essentially identical to the configuration of the removably connected first and second cards, said backing member being adhesively and removably secured to the adhesive layer on the undersides of the first and second cards, the perforated tear line extending through both the joined first and second cards and through the backing sheet, the component of the backing sheet on the underside of one of the cards being removable therefrom independently from the component of the backing sheet on the underside of the other card, enabling adherence of said cad to said catalogue, brochure or the like, the first card be separable from the second card along said perforated line.

2. A business card assembly as recited in claim 1, wherein said first business card and said second business card are substantially the same size.

* * * * *